United States Patent [19]

Sone et al.

[11] 4,369,343

[45] Jan. 18, 1983

[54] IGNITION DISTRIBUTOR HAVING ELECTRODES WITH THERMISTOR DISCHARGING PORTIONS

[75] Inventors: Masazumi Sone, Tokyo; Iwao Imai, Yokosuka, both of Japan

[73] Assignees: Nissan Motor Co., Ltd., Yokohama; Hitachi, Ltd., Tokyo, both of Japan

[21] Appl. No.: 209,028

[22] Filed: Nov. 21, 1980

[30] Foreign Application Priority Data

Nov. 26, 1979 [JP] Japan ..... 54-152061
Dec. 27, 1979 [JP] Japan ..... 54-169273
Apr. 3, 1980 [JP] Japan ..... 55-42844

[51] Int. Cl.[3] ..... H01H 19/00; F02P 1/00

[52] U.S. Cl. ..... 200/19 R; 123/146.5 R; 123/633; 200/19 DR; 200/19 DC

[58] Field of Search ..... 200/19 R, 19 DR, 19 DC, 200/262–270; 123/146.5 R, 146.5 A, 633

[56] References Cited

U.S. PATENT DOCUMENTS 4,039,787 8/1977 Hori et al. ..... 200/19 R
4,135,066 1/1979 Yamanaka et al. ..... 200/19 R X
4,217,470 8/1980 Kirher ..... 200/19 DR X

*Primary Examiner*—J. R. Scott
*Attorney, Agent, or Firm*—Lane, Aitken, Kice & Kananen

[57] ABSTRACT

An apparatus for suppressing noise radiating from an ignition system for an internal combustion engine is disclosed. The ignition system comprises a distributor which uses an electrically conductive ceramic or a PTC (Positive Temperature Coefficient) thermistor as a material for a rotary electrode and/or stationary electrodes. At least a spark discharging portion of the rotary electrode and/or spark discharging portions of the stationary electrodes are formed from the electrically conductive ceramic which has a resistivity ranging from $10^{-6}$ to $10^{-2}$ohm·cm or from the PTC thermistor. Cooperating with them are the high resistor spark plug and the high tension resistor cable. The high resistor spark plug herein disclosed uses an elongate monolithic resistor which has a length not shorter than 8 mm and preferrably has a length of 15 mm.

2 Claims, 10 Drawing Figures

IGNITION DISTRIBUTOR HAVING ELECTRODES WITH THERMISTOR DISCHARGING PORTIONS

BACKGROUND OF THE INVENTION

1. Field of the Invention

The present invention relates to an apparatus for suppressing noise which radiates from an ignition system for an internal combustion engine.

2. Description of the Prior Art

The noise which radiates from an ignition system for an internal combustion engine for an automobile or the like disturbs radio broadcasting service, television broadcasting service and other kinds of radio communication systems. Further, the noise causes operational errors in electronic control circuits of vehicle control systems, for example, E.F.I. (electronically controlled fuel injection system), E.S.C. (electronically controlled skid control system) or E.A.T. (electronically controlled automatic transmission system), and as a result, traffic safety is threatened. Thus, it is demanded to suppress radiation of the noise from the ignition system.

Three main causes of noise are: (1) a spark discharge between the spark plug electrodes, (2) a spark discharge between the distributor rotor and stationary electrodes, and (3) a spark discharge between the breaker contacts of the distributor.

For the purpose of suppressing the noise due to the cause (2) as above, there have been proposed various kinds of apparatuses which are mentioned below from (A) to (D), but each of them has a disadvantage which is not yet solved.

(A) A distributor employing a resistor distributor rotor:

The rotor having a resistor embedded therein is called a "resistor rotor." Because there is a distributed capacity in parallel to the resistor of the distributor rotor, the noise occurring during a high frequency band which exceeds 300 MHz is not reduced sufficiently. As the resistor of the distributor rotor electrode is of the order of several k·ohm, a loss in the spark energy at the rotor electrode is great.

(B) A distributor employing a flame spraying rotor:

The rotor has a rotor electrode which has a flame sprayed layer of a high resistive material thereon. Because the high resistive metal layer is formed on the surface of the electrode, the spark energy loss at the electrode is great. The noise suppressing effect is a value ranging from 4 to 5 dB. Further, the high resistive material layer is apt to be peeled off.

(C) A distributor employing rotor and stationary electrodes with an enlarged gap therebetween:

The discharge gap between the rotor and stationary electrodes measures a value within the range from 1.524 to 6.35 mm. Although the noise suppressing effect, for example, a value within a range from 15 to 20 dB, is provided for, the enlarged discharge gap causes a great loss in the spark energy. This great loss in the spark energy is against the recent requirement on the ignition system that the ignition be assured with a sufficient energy for the purpose of enhancing purification of exhaust gas and enhancement of fuel economy.

(D) A distributor having a third electrode in the vicinity of the rotor electrode:

The third electrode is attached to the rotor electrode via a dielectric therebetween. As the rotor electrode approaches the stationary electrode, the gap between the third electrode and the stationary electrode breaks down to induce the breakdown across the gap between the rotor and stationary electrodes. A disadvantage of this distributor resides in its complicated structure which causes a less reliable operation over a long use.

SUMMARY OF THE INVENTION

According to the present invention, a distributor for an internal combustion engine comprising:

a distributor rotor having a rotor electrode including a discharging portion;

a plurality of stationary electrodes, each of which includes a discharge portion and is arranged along a circular locus defined by the rotating discharging portion of said rotor electrode and the discharging portion of each of said plurality of stationary electrodes as said rotor rotates:

at least one of said discharging portion of said rotor electrode and said discharging portion of each of said stationary electrodes is made of a positive temperature coefficient (PTC) thermistor.

DESCRIPTION OF THE PREFERRED EMBODIMENTS

Figure 1:
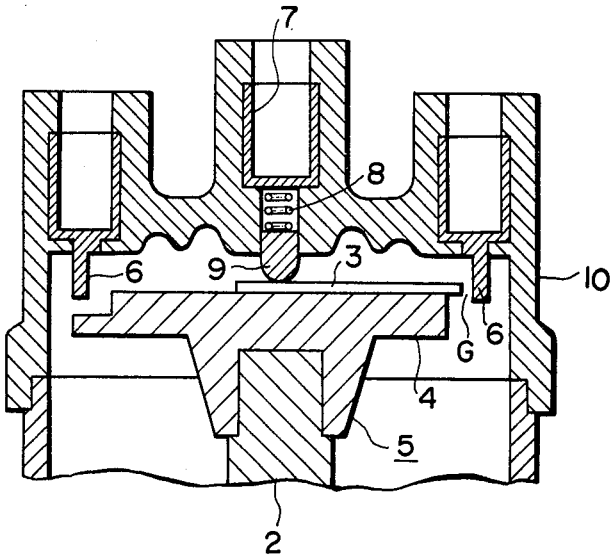
FIG. 1 is a sectional view of an upper part of a distributor.

Referring to the drawings and particularly to FIG. 1, there is shown an example of a distributor to which the present invention is applied.

Referring to FIG. 1, the distributor has a housing 1 and a rotor shaft 2. The rotor shaft 2 cooperates with a cam shaft of the engine to be rotated thereby. Mounted on the shaft 2 is a rotor 5 including a rotor electrode 3 and an insulator 4 to which the rotor electrode 3 is fixed. A cap 10 for the distributor is mounted to the housing 1 and has a center terminal 7 fixedly mounted to the center portion thereof and a plurality of stationary terminals 6, corresponding in number to the number of the cylinders, circumferentially arranged along a circular locus defined by the distributor rotor 5. The reference numeral 8 designates a spring, which biases the carbide electrode 9 to keep it in contact with the rotor electrode 3.

The center terminal 7 is connected to an ignition coil (not illustrated) of an ignition system, while, the stationary electrodes 6 are connected to spark plugs (not illustrated). The high electric voltage from the ignition coil is transmitted to the center terminal 7 and thereafter through the spring and the carbon electrode 9 to the rotor electrode 3. If the voltage overcomes the resistance to cause a breakdown across the discharge gap G between the tip portion of the rotor electrode 3 and the stationary electrode 6, the transmission of the voltage is allowed to the spark plugs.

In the operation above, the high electric voltage from the ignition coil rises toward its peak not in a step-like manner but rises with the time constant determined by the circuit constant. When the voltage rises to a value high enough to cause a breakdown of the spark gap G, the gap is broken down to allow a spark discharge. In this case, since, when the voltage reaches the above value, the breakdown of the insulation takes place rapidly, the discharge current flows rapidly within a short pulse width (several tens to hundred amperes) and this current is unstable and has a high peak, a great deal of toxic high frequency components are generated and thus electric noise wave radiates outwardly using the high tension cables as an antenna.

It is recognized that the noise which radiates from a source of noise is proportional to the noise current. Thus, it is necessary to reduce the noise current for the purpose of suppressing the radiation of noise.

The noise current corresponds to capacity discharge current $i_c$ that makes up the discharge current flowing across the rotor and stationary electrodes together with dielectric discharge current $i_L$.

The capacity discharge current $i_c$ occurs when the electric charges accumulated within the floating capacity between the rotor and stationary electrodes flow upon the breakdown of the insulation. This current flow takes place in a moment (the order of several n sec), thus the amount of current increases rapidly as shown by the dashed curve in FIG. 2. This current corresponds to the noise current.

The induction discharge current $i_L$ (several ten to one hundred Ma) begins to flow after the occurrence of the capacity discharge current and flows continuously. The spark energy supplied to the spark plug is generally proportional to the product $i_l \times T$, where $i_L$ is the induction discharge current and T the time period during which the discharge continues.

It therefore follows that, if the capacity discharge current $i_L$ is reduced, the noise is suppressed without any drop in the spark energy.

Figure 2:
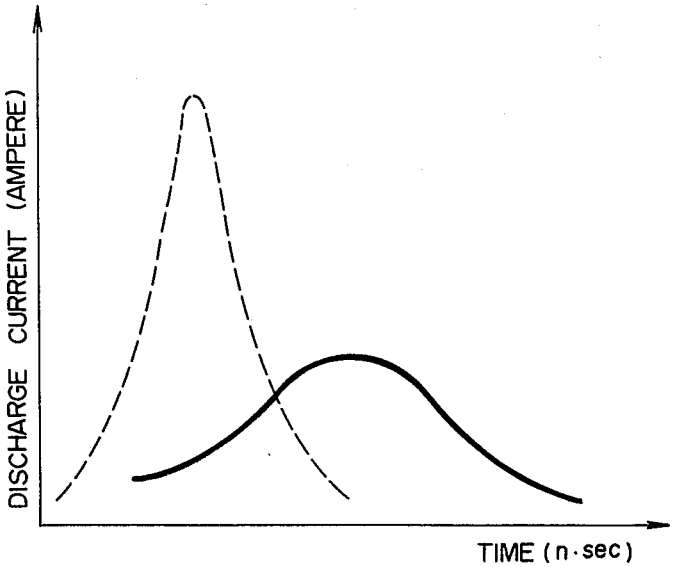
FIG. 2 is a graph showing discharge current vs. time curves.

It has been confirmed by the experiments conducted by the inventors of the present application that the capacity discharge current $i_L$ drops considerably as shown in FIG. 2 if a spark discharging portion of the rotor electrode and/or a spark discharging portion of each of the stationary electrodes are made of an electrically conductive ceramic having a resistivity falling within a range from $10^{-6}$ to $10^{-2}$ ohm·cm.

FIG. 2 shows a comparison of a distributor having a rotor electrode of copper with a distributor having a rotor electrode made of an electrically conductive ceramic which is a composite material formed by subjecting a mixture of a boron nitride (BN) with a titanium boride ($TiB_2$) which have been mixed at 1 to 1 ratio to heat and pressure according to hot pressing method. BN has a relatively large resistivity and $TiB_2$ a relatively small resistivity. The composite material formed from the mixture shows a resistivity within a range from 200 to 2000 ohm·cm.

In FIG. 2, the dashed curve shows a discharge current (in ampere) vs. time (in n·sec) relationship of the conventional distributor which uses the rotor electrode made of copper. As will be understood from the dashed curve, the amount of current increases rapidly.

The solid curve shows the discharge current vs. time relationship of the distributor which uses the composite material formed from the BN-$TiB_2$ mixture. It will be appreciated from the solid curve in comparison with the dashed curve that the rise in current has been made slow and the peak of the current has been decreased considerably.

As a result of using the electrically conductive ceramic as a material of the electrode, the high frequency components that turn into the noise have been considerably reduced.

Another advantage of the use of the rotor electrode made of the electrically conductive ceramic resides in that the voltage necessary to overcome the resistance to cause a discharge across the rotor and stationary electrodes is considerably reduced. The level of this voltage is within a range from 9 to 12 kV where the rotor electrode is made of copper, while, the level of this voltage drops considerably and ranges from 4 to 5 kV where the rotor electrode is made of the electrically conductive ceramic which has a resistivity ranging from $10^{-6}$ to $10^{-2}$ ohm·cm.

This drop in the breakdown voltage decreases a loss in energy consumed across the rotor electrode and stationary electrodes, thus ensuring the transmission of a sufficient amount of energy to the spark plugs.

Measurement has been conducted outside of an automobile having a 4-cylinder 1800 cc internal combustion engine which is provided with an ignition system using the conventional distributor with the rotor of copper to obtain a noise electric wave radiating from the distributor of the ignition system. Similarly, the measurement has been conducted to obtain a noise electric wave radiating from the distributor using the electrically conductive ceramic instead of copper.

Figure 3:
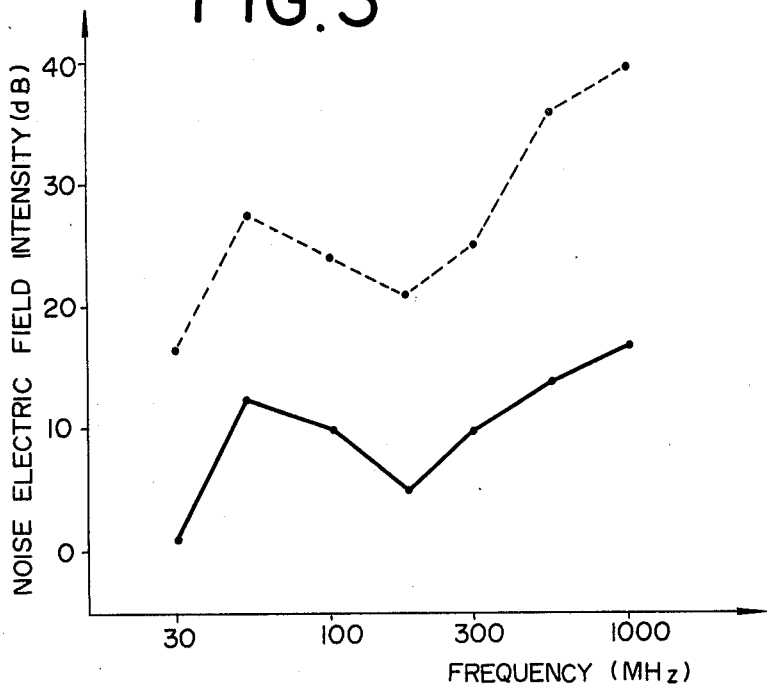
FIG. 3 is a graph showing noise electric field intensity (dB) vs. frequency (MHz) curves.

The data when the engine operates at 1500 rpm with no load are plotted in FIG. 3. In FIG. 3, the axis or ordinates shows noise electric field intensity in dB where $1\mu V = 0$ dB. The axis of the abscissa shows frequency in MHz. The dashed curve represents the characteristic obtained by the distributor having the rotor electrode made of copper. The solid curve shows a characteristic obtained by the distributor having the rotor electrode made of the electrically conductive ceramic.

As will be understood from FIG. 3, since the electrically conductive ceramic is used, noise electric field is reduced by an amount ranging from 15 to 20 dB as compared to the case where the copper is used.

The ceramic formed by boron nitride (BN) and titanium boride ($TiB_2$) has a resistivity ranging from 200 to 2000 ohm·cm and shows a good conductivity. Thus, as compared to the conventional resistor rotor, the resistivity of the rotor using the electrically conductive ceramic is very small, thereby to reduce the spark energy loss as the rotor and stationary electrodes almost to zero.

According to the experiment, good result has been obtained with the electrically conductive ceramic having a resistivity ranging from $10^{-6}$ to $10^{-2}$ ohm·cm.

In the preceding description, applicants showed, as an example of the electrically conductive ceramic suitable as a material of the distributor electrode, a composite material formed from a BN-$TiB_2$ mixture. A similar good result is obtained also with an electrically conductive material formed by sintering one material selected from the following group or a mixture of at least two materials selected from the following group. This mixture is sintered together with binder.

Examples are titanium carbide (TiC, approx. $10^{-4}$ ohm·cm in its resistivity), zirconium carbide (ZrC, approx. $5\times10^{-5}$ ohm·cm in the resistivity), titanium boride ($TiB_2$, approx. $3\times10^{-5}$ ohm·cm in the resistivity), zirconium boride ($ZrB_2$ approx. $2\times10^{-5}$ ohm·cm), molybdenum silicide ($MoSi_2$, approx. $2\times10^{-5}$ ohm·cm), cermet (Cr-$Al_2O_3$, approx. $10^{-5}$ ohm·cm in the resistivity; or WC-TiC-Co, approx. $10^{-5}\sim10^{-4}$ ohm·cm; or WC-TiC-Co, approx. $10^{-5}\sim10^{-4}$ ohm·cm; or $Cr_3C_2$, approx. $7\times10^{-5}$ ohm·cm; or 61.6TiC 22.2Ni 7.4$COC_5$ 1.4$M_o$, approx. $9\times10^{-5}$ ohm·cm), hafnium boride ($HfB_2$, approx. $10^{-5}$ ohm·cm), titanium nitride (TiN, approx. $2\times10^{-4}$ ohm·cm), vanadium nitride (VN, approx. $2.5\times10^{-4}$ ohm·cm), tantalum nitride (TaN, approx. $2\times10^{-4}$ ohm·cm), hafnium carbide (HfC, approx. $1.5\times10^{-4}$ ohm·cm), vanadium carbide (VC, approx. $1.5\times10^{-4}$ ohm·cm), niobium carbide (NbC, approx. $7\times10^{-5}$ ohm·cm), tantalum carbide (TaC, approx. $3\times10^{-5}$ ohm·cm), tungsten carbide (WC, approx. $5\times10^{-5}$ ohm·cm).

It is advantageous to form the electrically conductive ceramic form a mixture of ceramic having a relatively large resistivity (ceramic containing boride or an oxide or a nitride) with a ceramic having a relatively small resistivity in that a desired resistivity is obtained by changing the ratio of the mixture.

Although, in the preceding description the rotor electrode is made of the electrically conductive ceramic, the stationary electrodes may be made of from the electrically conductive ceramic or both of the rotor and stationary electrodes may be made of the electrically conductive ceramic.

Because that portion which has an influence upon the discharge is a discharging portion, for example, a tip of the rotor electrode and the opposed portions of the stationary electrodes, so that such discharging portions only may be made of the electrically conductive ceramic.

Figure 4:
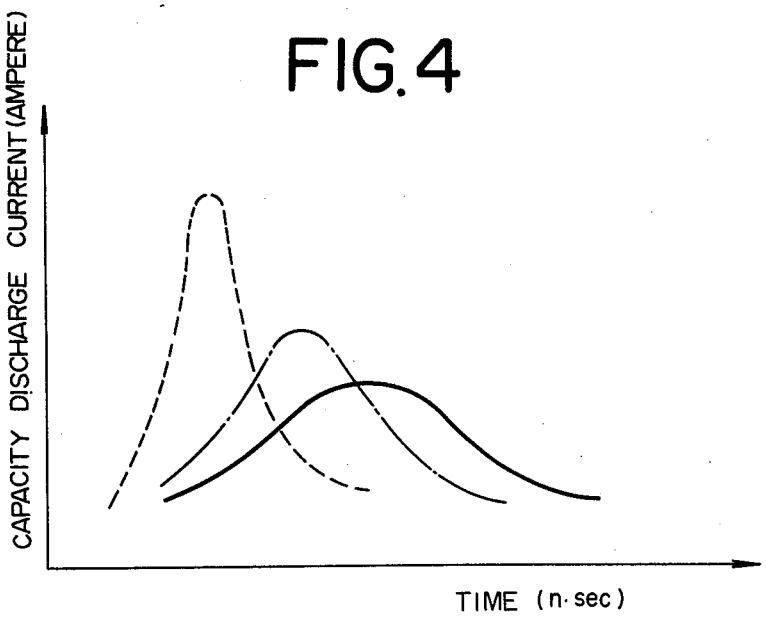
FIG. 4 is a graph showing discharge current vs. time curves.

Referring to a next example, at least a spark discharging portion of at least one of the rotor electrode and each of the stationary electrodes is formed by positive temperature coefficient (PTC) thermistor. In this case, the capacity discharge current is considerably reduced as shown in FIG. 4. It is considered that the reduction in the capacity discharge current is caused by a filter effect provided by the resistance and floating capacity of the positive temperature coefficient thermistor. However, although the use of the present material results in a reduction in the voltage necessary to overcome the resistance to cause the discharge, the reason for this is not yet known. In FIG. 4, the solid curve shows a characteristic of a distributor which has a rotor electrode of the PTC thermistor after warming-up, the one-dot-chain curve shows a characteristic of the distributor under cold condition, and the dashed curve shows a characteristic of a conventional distributor which has a rotor electrode of copper.

In the case where the rotor electrode of copper is used, the discharge voltage is within a range from 9 to 12 kV and the energy loss is within a range from 55 to 60mj. On the contrary, in the case where the rotor electrode of the positive temperature coefficient (PTC) thermistor, viz., sintered substance containing mainly barium titanate ($BaTiO_3$), the discharge electric voltage is within a range from 6 to 7 kV when the rotor electrode operates under cold condition and the energy loss under this condition is within a range from 50 to 60mj. while, after the discharge has continued for a while (after warming-up) the discharge electric voltage is within a range from 5 to 6 kV and the energy loss under this condition is within a range from 55 to 60mj. The energy loss variation depends upon the shape of the rotor electrode.

If the breakdown voltage is lowered, the loss is in the spark energy consumed at the gap between the distributor rotor and stationary electrodes, thus transmitting a sufficient amount of energy to the spark plugs. Because of its PTC characteristic, the material of the rotor electrode according to the present invention has a Curie temperature of Curie point and the resistivity increases in the vicinity of the Curie temperature (100° to 200° C. depending upon the material used). Thus, the resistivity is small during engine start-up when the temperature is low, providing good ignition performance. After warming-up of the engine, the temperature of the discharge portion increases and if the temperature increases beyond the Curie temperature, the resistivity increases, thus increasing the filter effect considerably. Therefore, it will be understood as an advantage that the distributor which uses the PTC thermistor combines improvement in start-up performance with consideration reduction in high frequency noise components that turn into noise.

Figure 5:
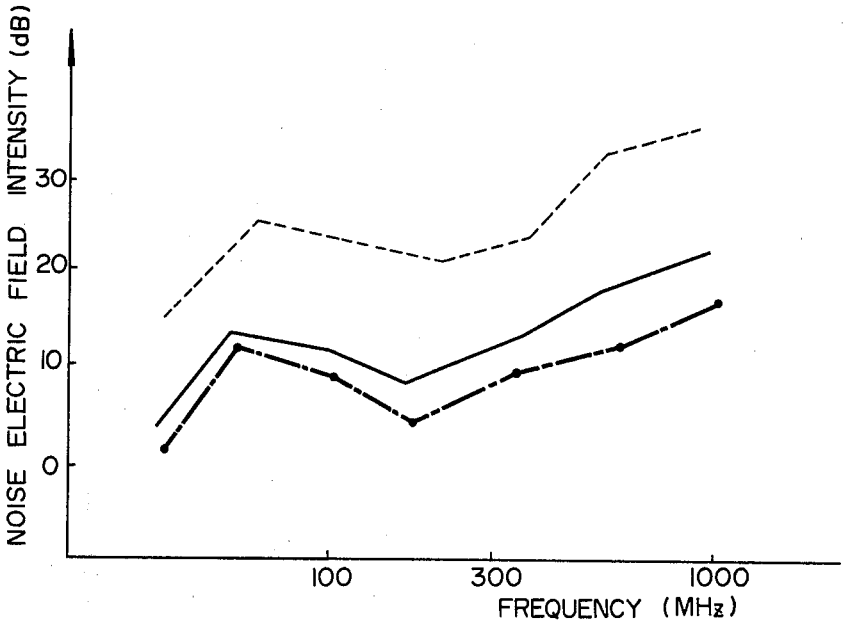
FIG. 5 is a graph showing the relationship between noise electric field intensity vs. frequency.

FIG. 5 is a similar graph to FIG. 3 showing noise field intensity vs. frequency characteristic curves, wherein the dashed curve is a characteristic of the distributor having the rotor electrode made of copper, the solid curve is a characteristic curve of the distributor having the rotor made of the PTC thermistor (sintered body containing mainly $BaTiO_3$) when the rotor electrode is cold, and the one-dot-chain curve is a characteristic of this distributor with the rotor electrode after warming-up. The axis of ordinates shows the noise field intensity in dB where 0 dB=1 $\mu$V/m. The axis of the abscissa shows frequency in MHz. The automobile tested has a 1800 cc 4-cylinder internal combustion engine provided with the conventional distributor having the rotor of copper or the distributor having the rotor of the PTC thermistor, and the data plotted in FIG. 5 are obtained when the engine operates at 1500 rpm with no load.

As will be understood from FIG. 5, the noise has been reduced by 15 dB as compared to the conventional distributor having the rotor electrode made of copper.

The manufacturing conditions, such as sintering and cooling conditions, of the PTC thermistor are explained hereinafter.

Figure 6:
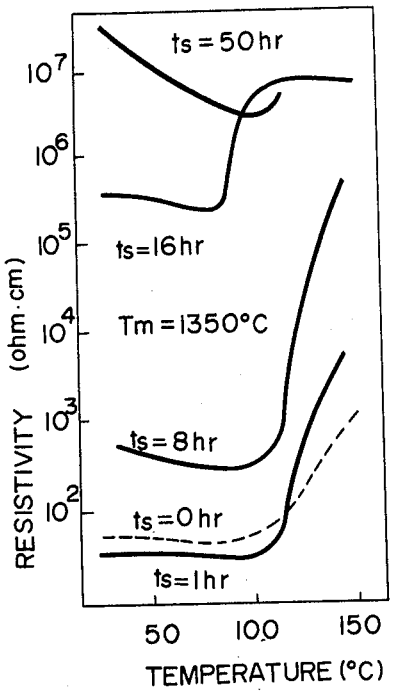
FIG. 6 is a graph showing the relationship between resistance vs. temperature depending upon the sintering time $t_s$ as a parameter.
Figure 7:
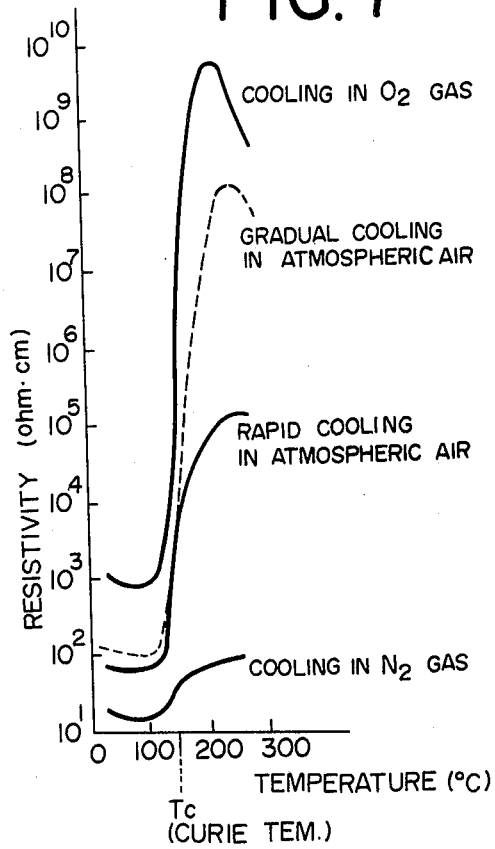
FIG. 7 is a graph showing the relationship between resistance vs. temperature depending upon the cooling rate as a parameter.
Figure 8:
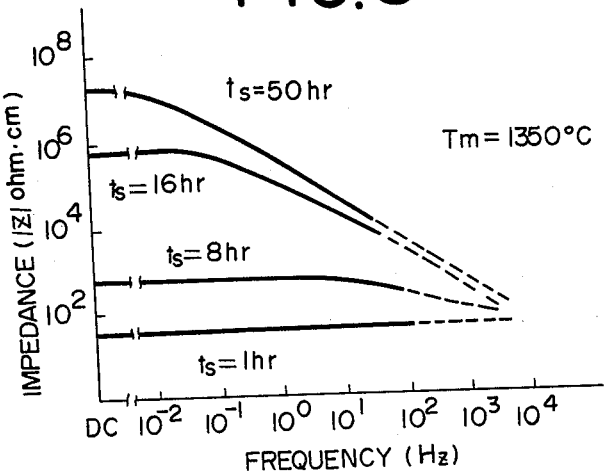
FIG. 8 is a graph showing the frequency characteristic of impedance depending upon the sintering time as a parameter.

FIG. 6 is a graph showing resistivity vs. temperature curves depending upon the sintering time as a parameter. FIG. 7 is a graph showing resistivity vs. temperature curves depending upon cooling rate as a parameter. FIG. 8 is a graph showing impedance vs. frequency curves depending upon sintering time as a parameter. In these FIGS. 6 to 8, the maximum sintering temperature Tm is 1350° C.

As will be understood from FIG. 6, if the sintering time (the time period during which the maximum temperature is maintained) exceeds 8 hours, the resistivity increases excessively and the energy loss increases too, and thus the sintering time should be shorter than 8 hours.

As will be understood from FIG. 7, the resistivity varies considerably depending upon the cooling rate after sintering. It is necessary that at engine start-up when the rotor electrode is cold, for example, when the temperature is lower than Curie temperature Tc, the resistivity is suppressed to low levels between $10 \sim 10^2$ ohm·cm so as to reduce loss in spark energy, and after warming-up, for example when the temperature is higher than the Curie temperature Tc, where the engine speed is stabilized, the resistivity is maintained at relatively high values between $10^2 \sim 10^5$ ohm·cm so as to increase the noise suppressing effect. It is also necessary that the resistivity does not increase excessively after warming-up. These requirements are met when rapid cooling is effected under the atmospheric air or when the cooling is effected under $N_2$ gas atmosphere. These requirements are not met when the cooling is effected under $O_2$ gas atmosphere or when the gradual cooling is effected under atmospheric air atmosphere. In the latter case, the resistivity is excessively high.

As will be understood from FIG. 8, if the sintering time $t_s$ is longer than 8 hours, the impedance during the low frequency range is excessively large. Thus, in this respect too, the sintering time should be shorter than 8 hours.

The explanation of the atmosphere which gives the PTC characteristic to the material will follows.

If the materal ($BaTiO_3$) which is to be sintered is pure, a very little amount of rare earth element such as La and Ce is added to the material and then is sintered under atmospheric air atmosphere. It may be sintered under an inert gas atmosphere or vaccum or a reducing atmosphere (such as $H_2$ gas atmosphere).

If the purity of the material is low, it is necessary that the sintering be carried out under an atmosphere without oxygen, such as under an inert gas atmosphere or a vacuum or a reducing atmosphere.

A preferred example is explained hereinafter.

A material containing $BaTiO_3$ as a main component is used. A very little amount of ion of lanthanum group is added to the material or ion such as Sb or Ni or Cr or Si is added to the material up to several molar percentage. The sintering is effected with the maximum temperature for a time period shorter than 8 hours and under atmosphere without oxygen. After being sintered, the material is rapidly cooled at a rate 500° C./hr under the atmospheric air atmosphere. If the cooling is to be carried out under the atmosphere without oxygen, it is not necessary to cool rapidly and the cooling may be carried out at a rate of 75° C./hr.

If the cooling proceeds under the atmosphere containing oxygen, oxidation progresses through the crystalline grain boundary and there occurs high resistance between the crystalline grain boundary and the crystalline grain, thus increasing the resistivity. Therefore, if, after sintering, the material is to be cooled under the atmosphere containing oxygen, the rapid cooling is necessary to prevent the resistivity from becoming excessively high.

By appropriately adjusting the length of the portion which is made of the PTC thermistor relative to the length of the metal portion, the desired resistivity characteristic of the discharging portion of the electrode can be obtained, so that the distributor can combine good ignitability at engine start-up with electric wave noise suppressing effect after warming-up.

As having been described, the use of the PTC thermistor is advantageous in that in addition to a great noise suppressing effect it ensures the transmission of sufficient spark energy to the spark plugs, thus ensuring ignition during cranking of the engine when the discharge electrode is cold and after warming-up the noise prevention effect is automatically enhanced. Since these advantages are obtained only by replacing the material of the electrode, it can be carried out without much cost increase.

Figure 9:
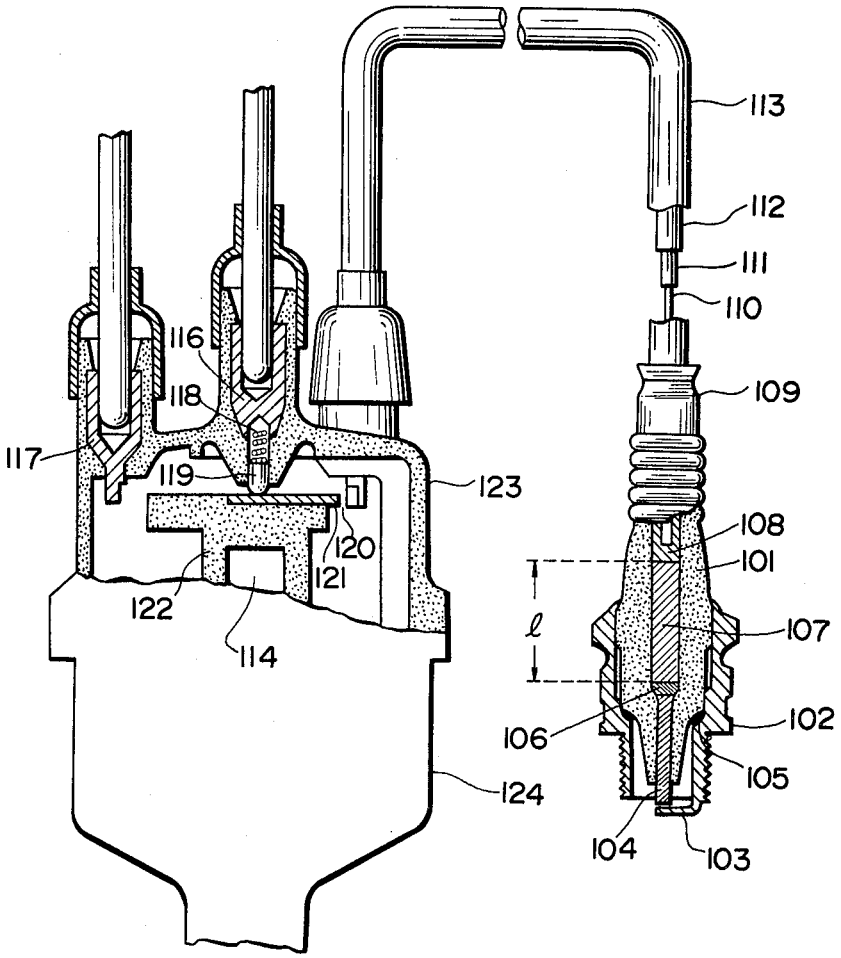
FIG. 9 is a side sectional view of an ignition system.

Referring to FIG. 9, an ignition system uses the noise suppressing type distributor previously described in connection with FIGS. 2 through 8.

The ignition system herein disclosed in FIG. 9 comprises: a plurality of long resistor spark plugs 101 which are mounted to all of the cylinders, respectively, of an internal combustion engine utilizing this ignition system, a distributor 124 which includes a plurality of stationary electrodes 117 connected to and corresponding to the spark plugs and a single rotor electrode 121, a plurality of noise preventing type high tension resistor cables 113, each including a resistor, one of which connects a central electric terminal 116 to an ignition coil (not illustrated), while the other plurality of cable connect the stationary electrodes 117 to the corresponding spark plugs 101, respectively.

Hereinafter, precise description as to each of the above components follows.

Each of the spark plugs 101 has a monolithic resistor 107 whose electric resistance falls within a range from 3 to 7 k·ohm and has a length l longer than 8 mm. The long resistance spark plug 101 includes a threaded plug portion 102 at the lower end to be screwed into the engine, a discharge electrode 104, the monolithic resistor 107, and a central electrode 108. This spark plug is different from and distinguished over the conventional resistor spark plug, which has a monolithic resistor with a length l falling within a range from 5 to 6 mm, in that the length l of the monolithic resistor is longer than 8 mm and is about 15 mm. The reference numeral 103 is a side electrode, 105 a seal ring, 106 a seal element, and 109 an axle cap.

Referring to the distributor 124, it includes a rotor shaft 114, a rubber cap 115, a central electrode 116, stationary electrodes 117, a spring 118, a ceramic electrode 121, a rotor 122, and a cap 123. The reference numeral 120 designates a discharge gap between the ceramic electrode 121 and each of the stationary electrodes 117. The rotor shaft 114 is operatively connected to a cam shaft of the engine through a gearing. A single ceramic electrode 121 is attached to the rotor 122. The stationary electrodes 117 are provided and correspond, in number, to the respective spark plugs. The ceramic electrode 121 is arranged such that it passes through the proximity of the stationary electrodes 117 one after another as the rotor 122 rotates. The discharge gap between the ceramic electrode 121 and each of the stationary electrodes 117 is within a range from 0.7 to 0.8 mm. The rotor electrode that is conventionally made of copper is made of the electrically conductive ceramic.

According to the experimental result, the electrically conductive ceramic having a resistivity falling within a range from $10^{-6}$ to $10^{-2}$ ohm·cm has provided a good result. That is, with the resistivity falling within the range as above, the electric resistance of the material of the electrode itself becomes very small, thus reducing a loss in the spark energy at the rotor electrode to substantially zero and effectively preventing the radiation of noise.

One example of an appropriate electrically conductive ceramic having a resistivity falling within the range as above and suitable for the material of the electrode is a ceramic which is a composite material formed by subjecting a mixture of BN with $TiB_2$ to heat and pressure according to the reaction hot pressing method. The ceramic obtained has a resistivity within a range from 200 to 2000 ohm·cm.

Referring to the electrical connection, the stationary electrode 117 and the corresponding long resistor plug 101 and the central electrode 116 and the unillustrated secondary winding of the ignition coil are connected by noise preventing type high tension cables 113, respectively. This kind of cable is available at the market and comprises carbon containing lead 110 covered by an insulator jacket 111 which is covered by a mesh structure 112.

Let us now consider why the noise is suppressed by the long resistor plug. The noise suppressing effect of this noise suppression-type resistor spark plug is derived from an electrostatic capacitance between the monolithic resistor 107 and the plug screw portion 102 and from a filter effect of the monolithic resistor 107. The practical monolithic resistor 107 has a parallel capacitance. If this parallel capacitance is large, a high frequency electric current passes through this parallel capacity toward the plug axle head side, thus degrading the filtering effect. While the same resistor material, the more the length l of the monilithic resistor 107, the smaller the parallel capacity becomes. Practically, the reduction of the parallel capacity is the greatest if the length of approximately 15 mm.

Referring to the distributor wherein the rotor thereof is made of the electrically conductive ceramic, the reason for the noise suppressing effect is not yet completely made clear. Experimentally, it is however confirmed that a voltage above which the discharge takes place is lowered and high frequency component is appreciably reduced.

The use of electrically conductive ceramic is advantageous is that a loss in spark energy at the electrode is made small.

The noise suppressing effect of the noise suppression-type high tension cable is well known, thus description thereof being omitted for brevity.

Even if one of three measures is taken, the noise suppressing effect is not effective because of a masking effect of a relatively large noise component emitted from the other parts of the ignition system which is not provided with any noise suppressing measure. According to the present invention the above three effective noise suppressing measures are used at the same time in the ignition system, providing a good effect due to the combination of these measures.

Figure 10:
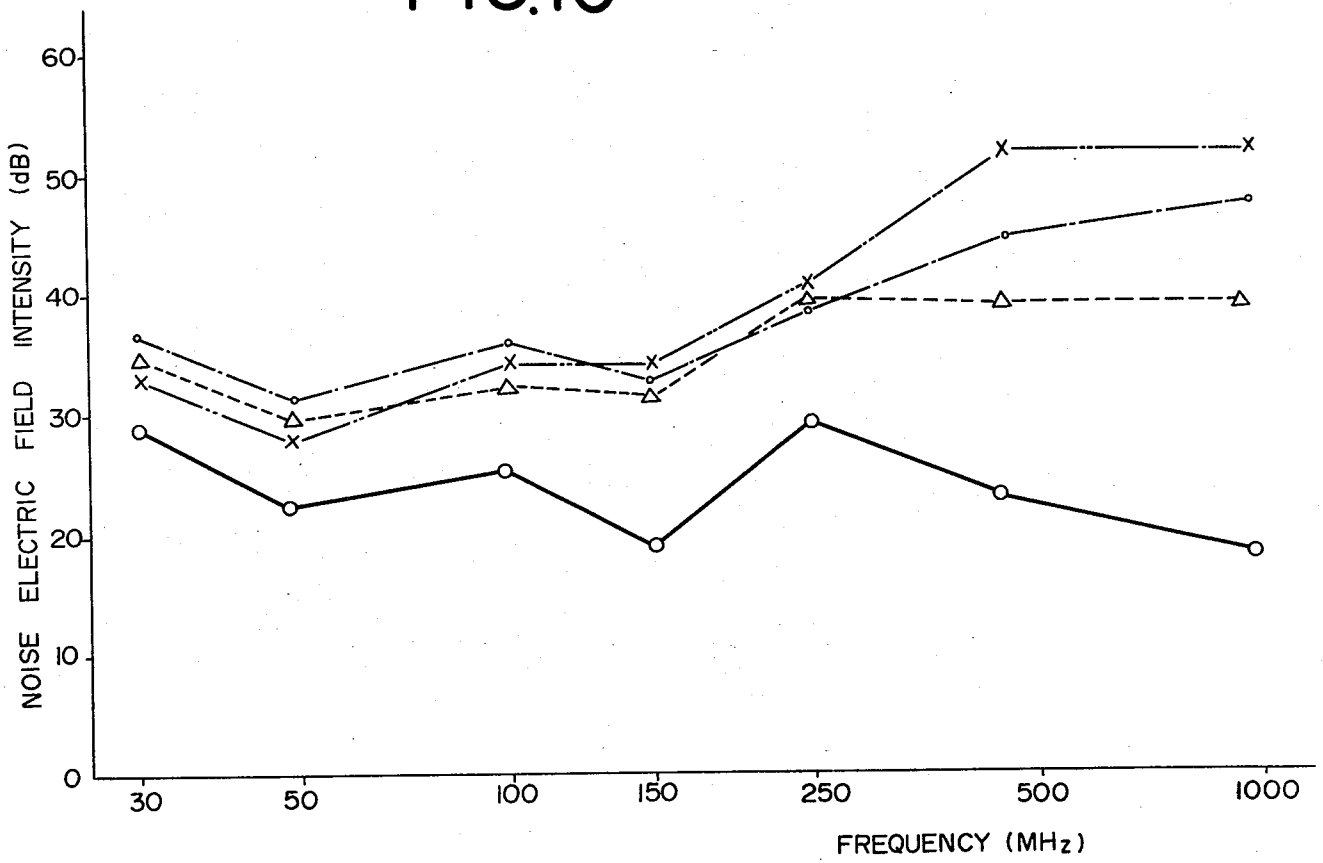
FIG. 10 is a graph showing noise field intensity vs. frequency curves.

FIG. 10 is a graph showing the relationship between noise field intensity and frequency. In FIG. 10, the solid curve shows a characteristic of the ignition system described in connection with FIG. 9, the dashed curve shows a characteristic of an ignition system having the distributor having the rotor electrode made of the electrically conductive ceramic, only, one-dot-chain curve shows a characteristic of an ignition system having the noise suppressing type high tension resistor cables, only, and the two-dots-chain curve shows a characteristic of an ignition system having the long resistor spark plugs, only. The experimental results plotted in FIG. 10 are data of the noise electric field which radiates from a 4-cylinder, 1600 cc internal combustion engine installed in an automobile depending upon various ignition systems as above.

As will be understood from FIG. 10, according to the ignition system shown in FIG. 9, a noise suppressing effect in the degree of 10~30 dB is obtained as compared to the other ignition systems as above, and the effect in the high frequency range is quite noticeable.

As will be understood from the preceeding description as to the ignition system, since every component forming the secondary side of the ignition system is provided with a noise suppressing measure, there is a combination effect, thus cooperating to result in a considerably great noise suppressing effect without any ill effect on the engine performance.

What is claimed is:

1. A distributor for an internal combustion engine, comprising:

a distributor rotor having a rotor electrode including a discharging portion;

a plurality of stationary electrodes, each of which includes a discharging portion and is arranged along a circular locul defined by the rotating distributor rotor with a discharging gap defined by the discharging portion of said rotor electrode and the discharging portion of each of said plurality of stationary electrodes as said rotor rotates;

at least one of said discharging portion of said rotor electrode and said discharging portion of each of said stationary electrodes is made of a positive temperature coefficient (PTC) thermistor.

2. A distributor as claimed in claim 1, wherein said positive temperature coefficient (PTC) thermistor is a semiconductor in the form of a sintered barium titanate ($BaTiO_3$) which is formed by sintering under an inert gas or vacuum or a reducing atmosphere a barium titanate with an additive of a very small amount of oxide of rare earth element or antimonide.

* * * * *